US006386112B1

(12) United States Patent
Shelton

(10) Patent No.: US 6,386,112 B1
(45) Date of Patent: May 14, 2002

(54) AERIAL PYROTECHNIC PRODUCT WITH RETARDED POST-EXPLOSION DESCENT

(76) Inventor: Gregory P. Shelton, 24073 24th St., Eagleville, MO (US) 64442

( * ) Notice: Subject to any disclaimer, the term of this patent is extended or adjusted under 35 U.S.C. 154(b) by 0 days.

(21) Appl. No.: 09/846,992

(22) Filed: May 1, 2001

(51) Int. Cl.[7] ..... F42B 4/00
(52) U.S. Cl. ..... 102/348
(58) Field of Search ..... 102/348, 346, 102/340

(56) References Cited

U.S. PATENT DOCUMENTS

| | | | | | |
|---|---|---|---|---|---|
| 41,689 | A | * | 2/1864 | Edge | |
| 72,030 | A | | 12/1867 | Hadfield | |
| 133,234 | A | | 11/1872 | Licht | |
| 148,553 | A | | 3/1874 | Detwiller | |
| 276,007 | A | | 4/1883 | Detwiller | |
| 303,839 | A | | 8/1884 | Hadfield | |
| 310,598 | A | | 1/1885 | Linton | |
| 753,151 | A | | 2/1904 | Lloyd | |
| 3,351,013 | A | * | 11/1967 | Simmons | 102/356 |
| 3,735,706 | A | * | 5/1973 | Elstow et al. | 102/34.1 |
| 3,749,019 | A | * | 7/1973 | Hancock et al. | 102/34.4 |
| 3,903,801 | A | * | 9/1975 | Senocki | 102/34.1 |
| 4,418,624 | A | * | 12/1983 | Willi et al. | |
| 4,649,826 | A | * | 3/1987 | Stevens | 102/340 |
| 4,687,455 | A | * | 8/1987 | Sculatti | 446/52 |
| 4,771,695 | A | | 9/1988 | Simpson | 102/343 |
| 4,917,015 | A | | 4/1990 | Lowery | 102/342 |
| 5,386,781 | A | * | 2/1995 | Day | 102/340 |
| 5,567,907 | A | | 10/1996 | Westfall | 102/344 |

OTHER PUBLICATIONS

1994 Estes Catalog (Cover page and pp. 3, 6, 7, 8, 9, 55, 57.

* cited by examiner

*Primary Examiner*—Michael J. Carone
*Assistant Examiner*—Denise J Buckley
(74) *Attorney, Agent, or Firm*—Hovey Williams LLP

(57) ABSTRACT

An aerial fireworks product has an exploding part that produces desired sights and sounds upon reaching an appropriate height above the ground, and a non-exploding part that returns to earth following the explosion. An air brake as part of the device is integrated into the structure in such a manner that it provides little or no in-flight drag during launching of the device. However, upon explosion, the brake bursts out into petals or flaps that remain secured to the non-exploding part so as to create additional air drag to retard the descent of the non-exploding part. In its preferred form, the brake is in the nature of a paper collar secured to the stabilizing base of the product yet positioned in close proximity to the exploding part so as to burst into the air drag-creating configuration upon denotation of the exploding part.

10 Claims, 4 Drawing Sheets

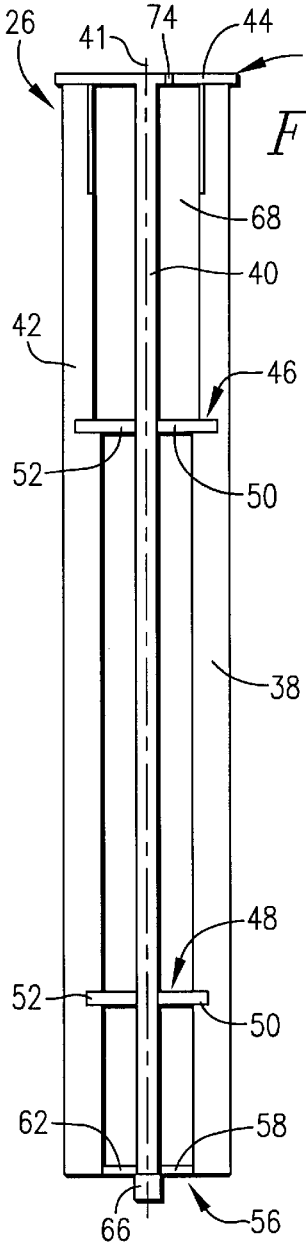
FIG. 4.
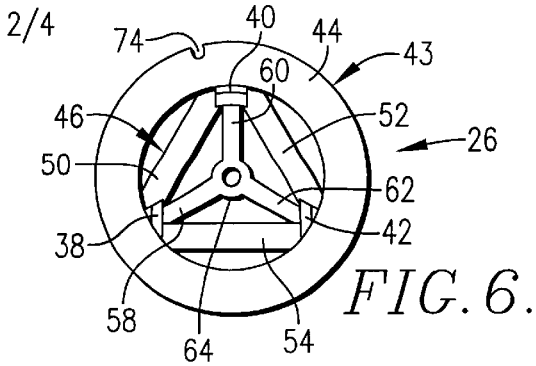
FIG. 6.
FIG. 3.
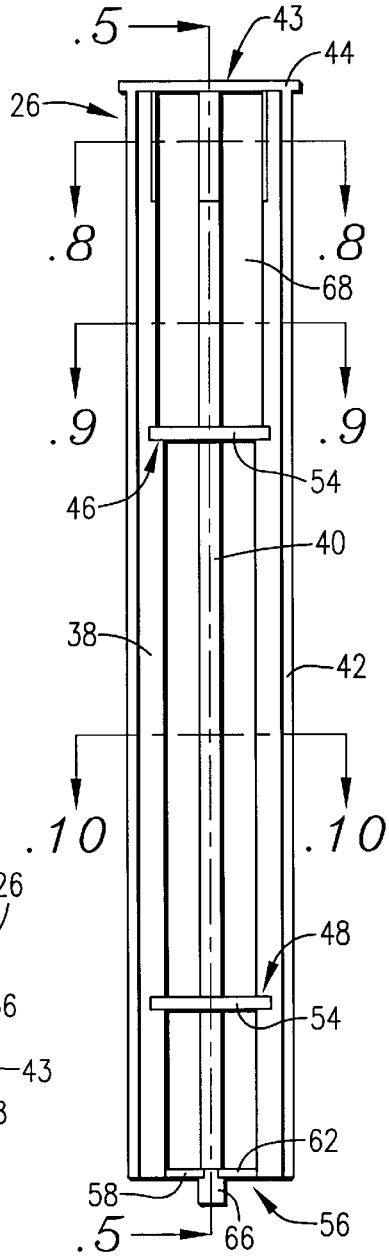
FIG. 5.
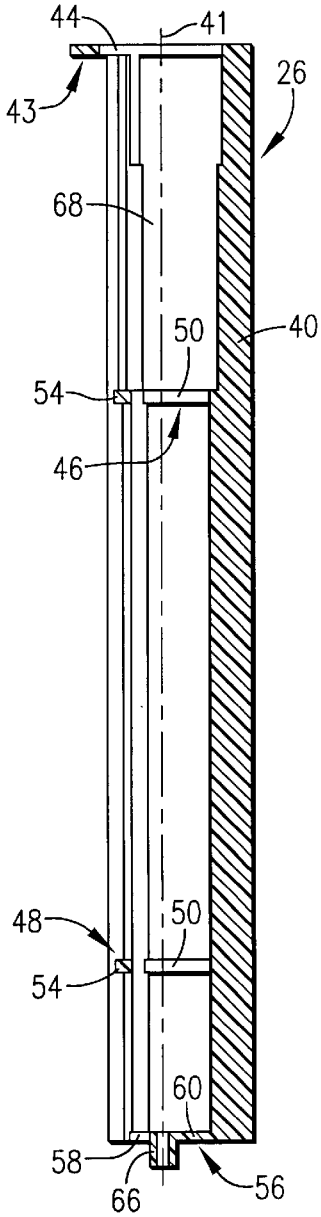
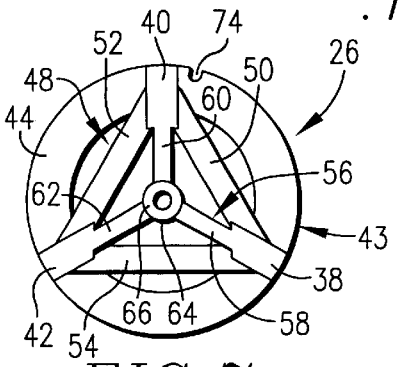
FIG. 7.

AERIAL PYROTECHNIC PRODUCT WITH RETARDED POST-EXPLOSION DESCENT

TECHNICAL FIELD

The present invention relates generally to fireworks and, more particularly, to an aerial product having a built-in air brake that only deploys upon detonation of the product so as to create an air drag as the non-exploding part of the product returns to earth, thereby making the descent gentler than would otherwise be the case.

BACKGROUND

Some aerial fireworks products have a significant amount of non-exploding structure that returns to earth by gravity after the exploding part has detonated. See, for example, the products disclosed in my co-pending applications Ser. No. 09/482,579 filed Jan. 13, 2000 titled "Aerial Fireworks Product" and Ser. No. 09/751,853 filed Dec. 29, 2000 titled "Aerial Fireworks Product having Synthetic Resinous Stabilizing Base."

SUMMARY OF THE INVENTION

The present invention relates to a simple, yet effective way of increasing the air drag on the non-exploding part of the product as it returns to earth so as to make the descent more gentle, while avoiding increased drag during launching of the device. The improvement is particularly well-suited for products of the type disclosed in my two earlier referenced applications, but is not limited to those particular types of products.

The present invention provides an air brake in the nature of a collar disposed in close proximity to the exploding part of the product, yet secured to the non-exploding part. The collar and exploding part are configured to provide an essentially streamlined exterior without significant air drag prior to detonation of the exploding part so as to avoid adversely affecting the flight characteristics of the product. When the exploding part detonates, the collar ruptures under the force of the explosion to produce petal or flap-like residue that remains attached to the non-exploding part to catch the air during descent and create increased drag. In its preferred form, the collar is constructed from built-up layers of paper sheets that are glued together to produce a wall thickness of approximately 0.040 inches.

BRIEF DESCRIPTION OF THE DRAWINGS

FIGS. 1–10 illustrate one type of aerial device with which the present invention can be used, wherein FIG. 1 is a vertical cross-sectional view of a launch tube and aerial device in the ready-to-launch mode;

FIG. 2 is an exploded isometric view of the aerial device showing the body and stablizing base as two separate parts prior to assembly;

FIG. 3 is an elevational view of the stabilizing base;

FIG. 4 is an opposite side elevational view of the base;

FIG. 5 is a longitudinal cross sectional view of the base taken substantially along line 5—5 of FIG. 3;

FIG. 6 is a top end elevational view of the stabiling base;

FIG. 7 is a bottom end elevational view of the stabilizing base;

FIG. 8 is a transverse cross sectional view through the base taken substantially along line 8—8 of FIG. 3;

FIG. 9 is a transverse cross sectional view through the base taken substantially along line 9—9 of FIG. 3;

FIG. 10 is a transverse cross sectional view through the base taken substantially along line 10—10 of FIG. 3;

DETAILED DESCRIPTION

Figure 1:
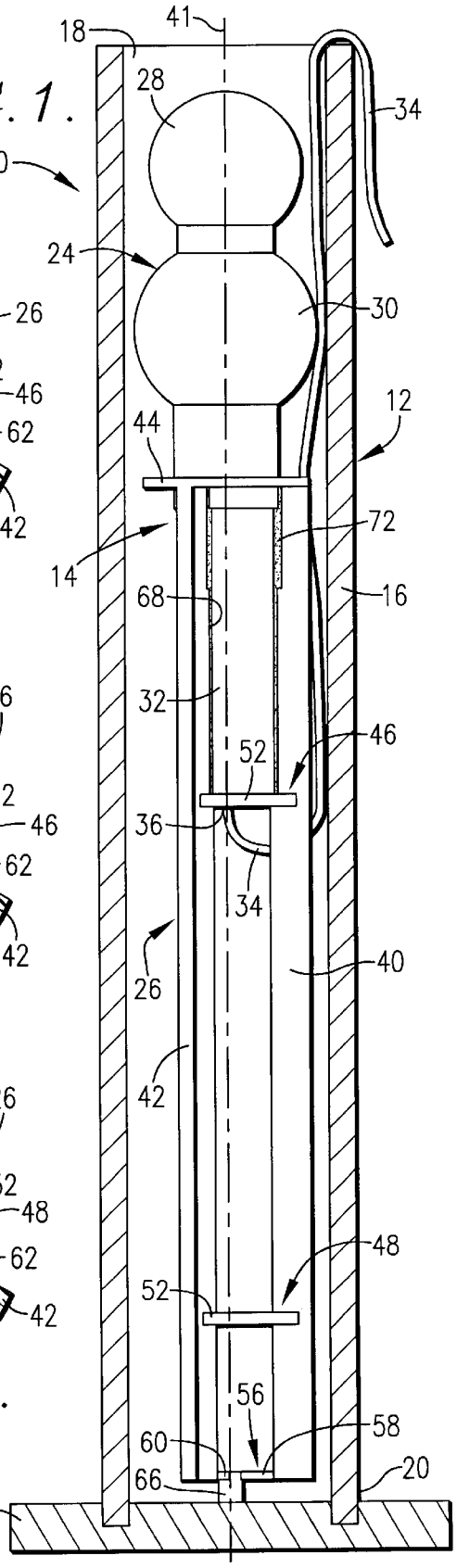
Figure 2:
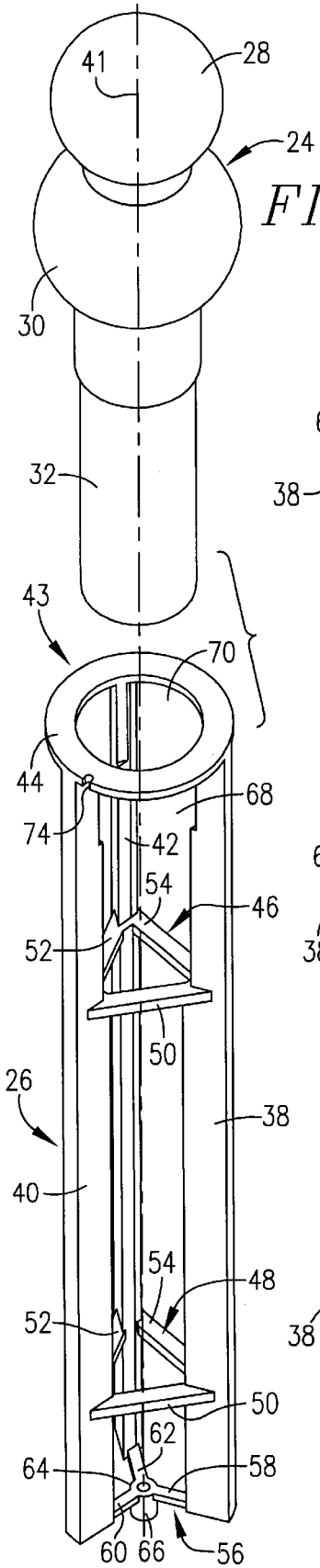

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments. As but one example, the present invention has been illustrated in connection with an aerial device in which the exploding part utilizes a pair of stacked balls. However, the principles of the present invention apply just as well to a device utilizing only one ball, for example, or a device in which the exploding part is shaped like a cylindrical cannister having a pointed nose cone.

One embodiment of an aerial pyrotechnic product is broadly denoted by the numeral 10 and includes two primary components, i.e., a launcher 12 and a self-propelled aerial device 14 adapted for use with launcher 12. Launcher 12 includes an upright tube 16 having an open upper end 18 and a closed lower end 20. A base 22 is secured to lower end 20 and is adapted to rest on a supporting flat surface in such a manner that tube 16 is disposed in an upright, essentially vertical disposition. Base 22 closes off the lower end of tube 16 and effectively defines a floor of the tube. In the disclosed embodiment, the tube 16 is preferably constructed of a plastic material but may be constructed from other acceptable materials such as, for example, paste board as well understood by those skilled in the art.

Aerial device 14 includes a body 24 and a stabilizing base 26. Body 24 comprises an incendiary portion and an engine portion, the incendiary portion including a pair of stacked balls 28 and 30 that produce a pyrotechnic display when ignited, in the particular embodiment illustrated in the drawings. The engine portion comprises a generally cylindrical engine 32 projecting downwardly from the bottom ball 30. Engine 32 contains a charge of propellant that, when ignited, provides lift for device 14 so as to render it self-propelled in nature. A long fuse 34 (FIG. 1), having a length that exceeds the total length of the device, is secured at point 36 to the bottom of engine 32.

Figure 8:
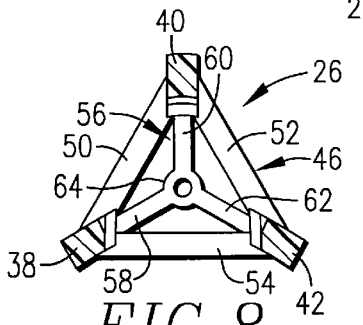
Figure 9:
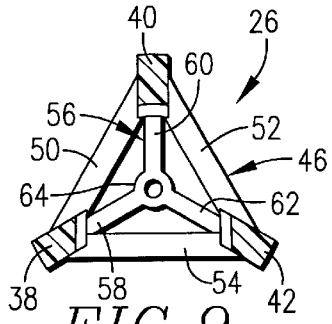
Figure 10:
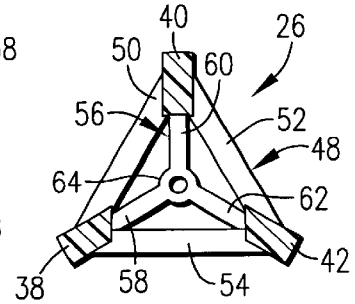
Figure 11:
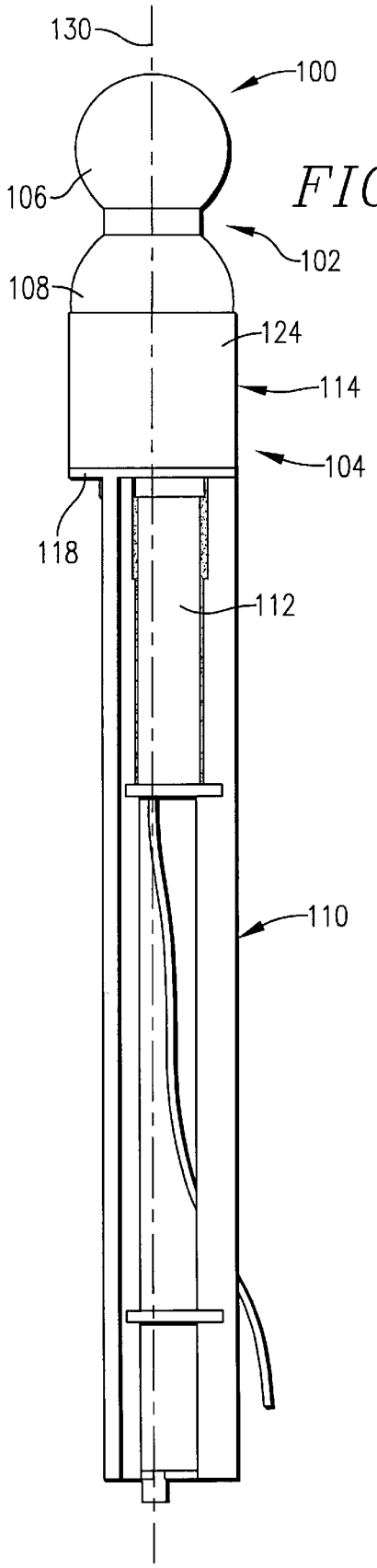
FIG. 11 is an elevational view of an aerial pyrotechnic device similar to that illustrated in FIGS. 1–10 with an added air brake collar in accordance with the principles of the present invention.

Stabilizing base 26 comprises a framework having three equal length, substantially identical, longitudinally extending legs 38, 40 and 42. Legs 38, 40 and 42 are spaced around the axis of symmetry 41 of the device at equal 120° degree intervals and are all spaced the same radial distance outwardly from such axis of symmetry. Generally speaking, legs 38, 40 and 42 are rectangular in overall cross sectional configuration as may be seen viewing FIGS. 8, 9 and 10, although the innermost surfaces of the legs may be provided with draft angles to facilitate manufacturing base 26 using an injection molding technique. The longitudinal axes of legs 38, 40 and 42 all extend parallel to the axis of symmetry 41.

The framework of base 26 further includes strut structure broadly denoted by the numeral 43 that interconnects legs 38, 40 and 42 with one another to retain them in their symmetrically disposed positions. Such strut structure 43 includes a ring 44 that covers and interconnects the uppermost ends of legs 38, 40 and 42. Additionally, strut structure 43 includes at least a pair of generally triangular strut units 46 and 48 spaced below ring 44 along the length of the legs. Strut units 46 and 48 are identical to one another, each having three horizontal struts 50, 52, and 54 that lie in a common horizontal plane and fixedly interconnect legs 38, 40 and 42.

Strut structure 43 also includes a lowermost spider 56 comprising three horizontal spokes 58, 60 and 62 that diverge from a central hub 64 to join with respective legs 38, 40 and 42. A tip-over projection or button 66 projects down from hub 64 beyond and below the legs 38, 40 and 42 to prevent stabilizing base 26 from being self-supporting in the event a user attempts to stand the base on a lower supporting surface outside of launch tube 16. In the preferred embodiment, stabilizing base 26 is integrally molded from a synthetic resinous material such as polyvinyl chloride.

At the upper end of stabilizing base 26, an elongated receiving socket 68 is defined by the proximal interior surfaces of legs 38, 40 and 42, as well as by a hole 70 in ring 44. Socket 68 receives engine 32 of body 24 as illustrated in FIG. 1, the upper strut unit 46 serving as a stop to limit the extent of insertion of engine 32. A layer of adhesive 72 along the length of engine 32 bonds the latter to legs 38, 40 and 42. The upper end of socket 68 may be slightly enlarged relative to the lower region thereof so as to accommodate engines 32 that may have upper portions of a larger diameter than lower portions. Preferably, the stop provided by upper strut unit 46 and the length of engine 32 are such that engine 32 is not fully received within socket 68 but instead projects a short distance upwardly therebeyond as illustrated in FIG. 1.

When the aerial device 14 is inserted into launch tube 16 with body 24 disposed upwardly, the tip-over button 66 engages base 22. However, the interior diameter of launch tube 16 is preferably only slightly greater than the maximum cross sectional width of aerial device 14 such that device 14 is retained by tube 16 in an essentially vertical orientation. Preferably, the internal diameter of the tube 16 exceeds the maximum transverse cross sectional width of the device 14 by an amount that is approximately double the thickness of fuse 34. This provides ample clearance for fuse 36 when device 14 is within tube 16 and fuse 34 is directed up along side device 14 and up over the upper edge of launch tube 16. A notch 74 in the outer periphery of ring 44 helps retain and locate fuse 34.

In a preferred embodiment launch tube 16 is somewhat taller than the overall length of aerial device 14 such that device 14 is completely received within tube 16 prior to launch and during ignition of fuse 34. Although tube may be somewhat shorter than illustrated, it should be at least as tall as necessary to partially surround the upper ball 28 of body 24.

FIGS. 11–14 illustrate one embodiment of the present air brake invention utilized in connection with a product of the type disclosed in FIGS. 1–10. In FIGS. 1–14, the aerial product 100 may be broadly described as having an exploding part 102 and a non-exploding part 104. The exploding part 102 comprises the two stacked balls 106 and 108, while the non-exploding part 104 comprises the base 110, the engine 112 that is integrally joined to lower ball 108, and the air brake 114.

Figure 12:
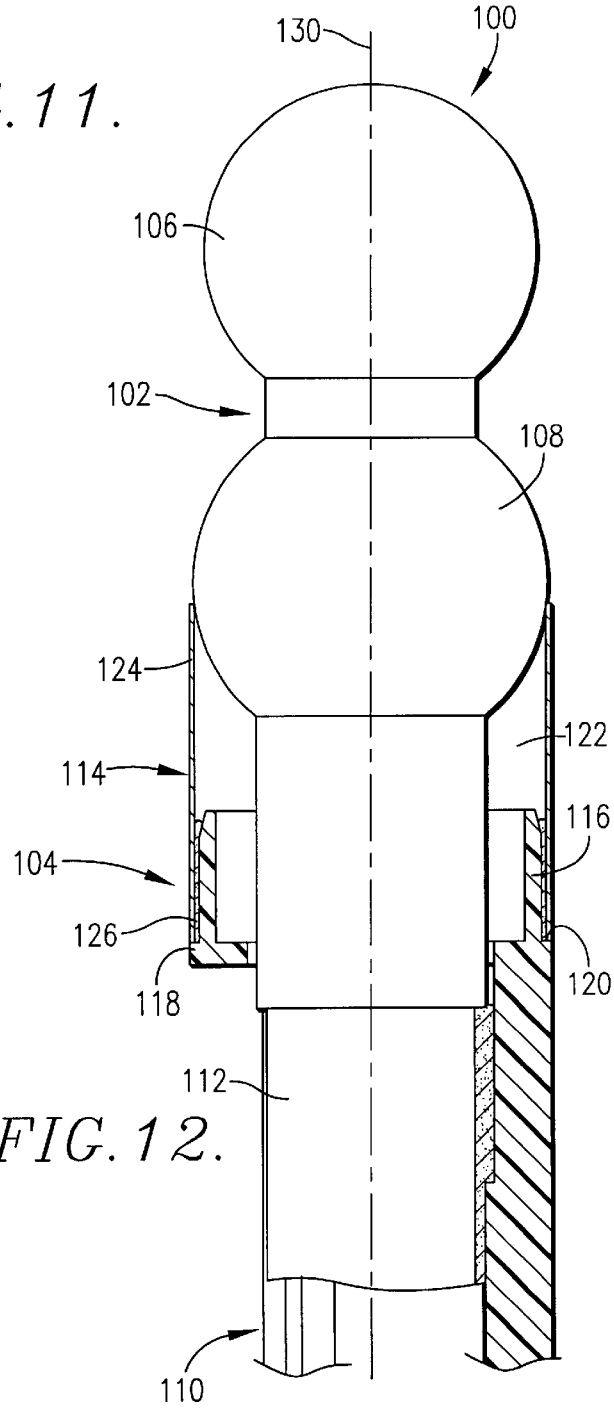
FIG. 12 is an enlarged, fragmentary vertical cross-sectional view thereof revealing details of construction.
Figure 13:
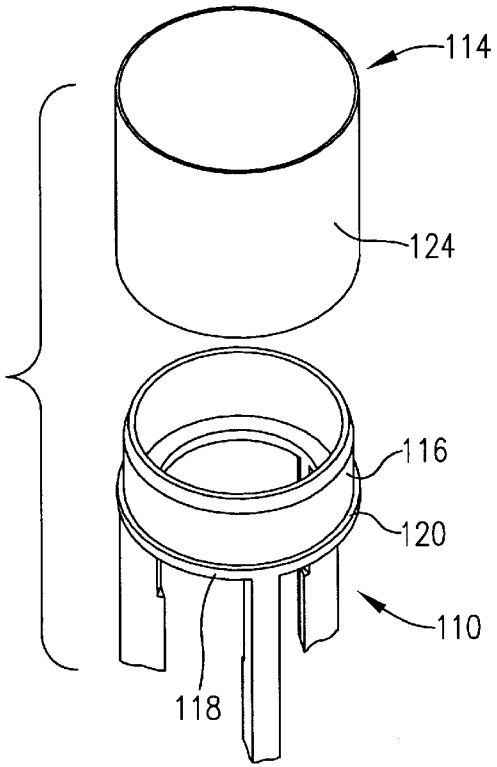
FIG. 13 is an exploded view of the air brake collar and upper end of the stabilizing base.

As illustrated particularly in FIGS. 12 and 13, the base 110 has an upstanding, annular wall 116 at its upper end that is integral with ring 118. Wall 116 has a slightly reduced outer diameter relative to that of ring 118 so as to present an upwardly facing, annular ledge 120 at the base of wall 116. Wall 116 circumscribes engine 112 in radially spaced relation thereto and terminates below lower ball 108 in spaced relationship therewith so as to define a gap 122 between the upper extremity of wall 116 and the lower extremity of ball 108.

Air brake 114, in the illustrated embodiment, comprises a collar 124 that surrounds wall 116 and rests on ledge 120. Collar 124 is bonded to the outer extremity of wall 116 by a layer of glue or the like 126. The upper end of collar 124 extends upwardly beyond wall 116 across gap 122 and into wedging engagement with the lower ball 108 slightly below its point of maximum diameter. The upper end of collar 124 is circular and thus makes contacting, mating engagement with the corresponding circular periphery of ball 108. In the illustrated embodiment, the upper end of collar 124 is not bonded to ball 108, but it is within the concepts of the present invention to provide a layer of glue at that location if desired.

In a preferred embodiment, collar 124 is constructed from built-up layers of paper sheets that are glued together to form a type of pasteboard or paperboard material. For ease of manufacturing, collar 124 may be constructed from a spiral wound tube or a convolute wound tube that is cut to length at several places along its length so as to produce multiple collars from one long tube. One preferred embodiment of collar 124 has a wall thickness of approximately 0.040 inches and a height of 1.625 inches. Another embodiment has the same wall thickness, but a height of 3.50 inches. A preferred internal diameter for collar 124 is approximately 1.50 inches.

It will be noted that the manner in which collar 124 tightly engages the lower circular periphery of ball 108 affords a streamline effect for product 100. In other words, there is virtually nothing about the collar 124 that provides an air drag as product 100 is propelled through the air by engine 112.

Figure 14:
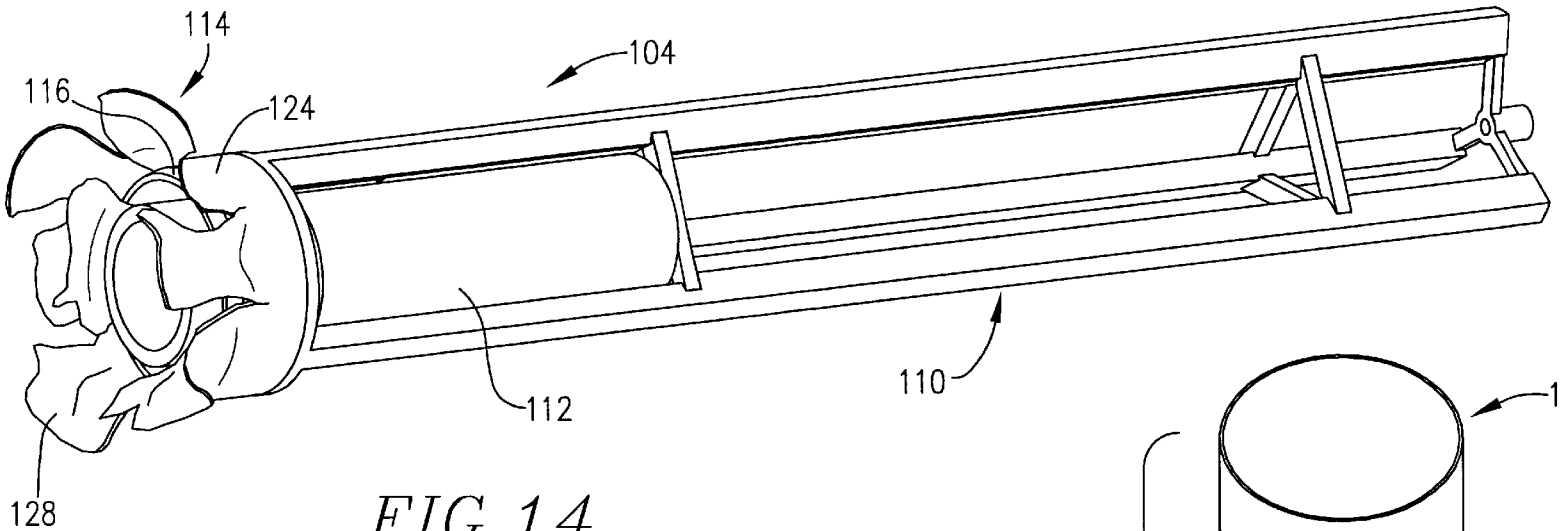
FIG. 14 is an isometric view of the device following denotation of the exploding part and illustrating the air drag residue presented by the collar following such explosion.

However, following denotation of exploding part 102, collar 124 takes on a much different appearance due to bursting by lower ball 108 when exploding part 102 is denotated. As illustrated in FIG. 14, when collar 124 bursts, it tends to form petals or flaps 128 that become disconnected in part from one another yet remain attached to wall 116 of base 110. The exact configuration of the collar residue from the explosion varies from product-to-product, i.e. some residue may present more flaps or petals than others, but in any event the loose pieces produce much more air drag surfaces than the intact collar.

Consequently, as the non-exploding part 104 starts its descent following explosion, the flaps 128 catch the air rushing by and flutter or flap as part 104 descends by gravity. Such action creates an air drag, with the result that part 104 tends to become disposed in a horizontal orientation and spin about an upright axis transverse to its axis of symmetry 130, retarding its descent.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby state(s) his intent to rely on the Doctrine of Equivalents to determine and assess the reasonably fair scope of his invention as pertains to any apparatus not materially departing from but outside the literal scope of the invention as set out in the following claims.

What is claimed is:

1. In a self-propelled aerial pyrotechnic device, the improvement comprising:

an exploding part adapted to detonate when the device has propelled itself to a height above the ground;

a non-exploding part adapted to return to earth by gravity following detonation of the exploding part; and an air brake secured to the non-exploding part, said air brake being configured and arranged to be substantially ineffective during lift-off of the device but constructed of such a material and so disposed with respect to the exploding part as to rupture under the force of the explosion to form petal-like residue attached to the non-exploding part that increases its drag and retards its descent as it returns to earth.

2. In a self-propelled aerial pyrotechnic device as claimed in claim 1, said air brake comprising a collar.

3. In a self-propelled aerial pyrotechnic device as claimed in claim 2, said collar being constructed of paper board material.

4. In a self-propelled aerial pyrotechnic device as claimed in claim 1, said air brake being constructed of paper board material.

5. In a self-propelled aerial pyrotechnic device as claimed in claim 1, said non-exploding part including a stabilizing base at the lower end of the device, said exploding part having a circular outer periphery located upwardly beyond said base, said air brake comprising a collar secured to said base and extending upwardly therefrom into surrounding engagement with said periphery of the exploding part.

6. In a self-propelled aerial pyrotechnic device as claimed in claim 5, said base having an annular wall at an upper end thereof projecting toward said periphery of the exploding part, said collar circumscribing said wall and projecting upwardly beyond the same into engagement with said periphery of the exploding part.

7. In a self-propelled aerial pyrotechnic device as claimed in claim 6, said collar being bonded to said wall.

8. In a self-propelled aerial pyrotechnic device as claimed in claim 7, said collar being constructed from paper board.

9. In a self-propelled aerial pyrotechnic device as claimed in claim 8, said base being constructed from synthetic resinous material.

10. In a self-propelled aerial pyrotechnic device as claimed in claim 5, said non-exploding part further including an engine integral with said exploding part and secured to said base.

* * * * *